US005309932A

United States Patent [19]

Chou et al.

[11] Patent Number: 5,309,932

[45] Date of Patent: May 10, 1994

[54] FOLDING COLLAPSIBLE FRAME ASSEMBLY FOR AN AUTOMATIC FOLDING UMBRELLA

[76] Inventors: Lue L. C. Chou, No. 1, Alley 9, Lane 250, Sec. 2, Cheng Gung Rd., Nei Hu Area Taipei; Jonathan Cheng, 5F, No. 10, Lane 169, Sec 1, Ta-an Rd., Taipei, both of Taiwan

[21] Appl. No.: 103,230

[22] Filed: Aug. 9, 1993

[51] Int. Cl.[5] ..... A45B 25/14

[52] U.S. Cl. ..... 135/22; 135/24

[58] Field of Search ..... 135/15.1, 22–24, 135/25.1, 20.3, 25.31, 25.33, 37, 38, 39, 40

[56] References Cited

U.S. PATENT DOCUMENTS

| | | | |
|---|---|---|---|
| 1,091,895 | 3/1914 | Schaap | 135/24 X |
| 3,687,146 | 8/1972 | Seitel | 135/24 X |
| 3,856,030 | 12/1974 | Sato | 135/24 X |
| 4,534,374 | 8/1985 | Day | 135/22 |
| 4,989,625 | 2/1991 | Wu | 135/22 |
| 5,058,613 | 10/1991 | Su et al. | 135/24 X |
| 5,144,969 | 9/1992 | Chan et al. | 135/22 |
| 5,232,004 | 8/1993 | Wu | 135/24 |

*Primary Examiner*—Carl D. Friedman
*Assistant Examiner*—Lan C. Mai
*Attorney, Agent, or Firm*—Bacon & Thomas

[57] ABSTRACT

A folding collapsible frame assembly for an automatic folding umbrella, which includes a lower shaft, an upper shaft made to slide in the upper shaft, a collapse control spring, a lock ring moved to lock the collapse control spring in the compressed condition as the umbrella is opened, a stretch control spring controlled by a bottom spring on the handle of the umbrella to automatically push the umbrella into the open condition, a guide control mechanism controlled by a control bottom on the handle of the umbrella to release the lock ring from the collapse control spring for allowing the umbrella to be collapsed automatically.

2 Claims, 4 Drawing Sheets

FOLDING COLLAPSIBLE FRAME ASSEMBLY FOR AN AUTOMATIC FOLDING UMBRELLA

BACKGROUND OF THE INVENTION

The present invention relates to umbrellas, and more specifically the present invention relates to a folding collapsible frame assembly for an automatic folding umbrella.

Various automatic umbrellas have been disclosed, and have appeared on the market. These automatic umbrellas are commonly complicated in structure and expensive to manufacture. Because of complicated structure, the assembly process is difficult to achieve, and the parts may be jammed during the operation.

U.S. Pat. No. 5,144,969, issued to the present invention, disclosed an automatic folding umbrella of which the shaft is consisted of several sections that slide one inside another and are controlled by a series of springs. The frame assembly of this structure of automatic folding umbrella is relatively heavy. Further, the springs may be tangled during the assembly process of the umbrella.

SUMMARY OF THE INVENTION

The principal object of the present invention is to provide a folding collapsible frame assembly for an automatic folding umbrella which is simple in structure and inexpensive to manufacture. The present invention uses a sliding key moved to control the compression and release of a collapse control spring so that the umbrella can be conveniently collapsed. A stretch control spring is retained between the upper runner and the lower runner, and controlled by a control button through a bottom spring to stretch the umbrella into the opened position.

DETAILED DESCRIPTION OF THE PREFERRED EMBODIMENT

Figure 1:
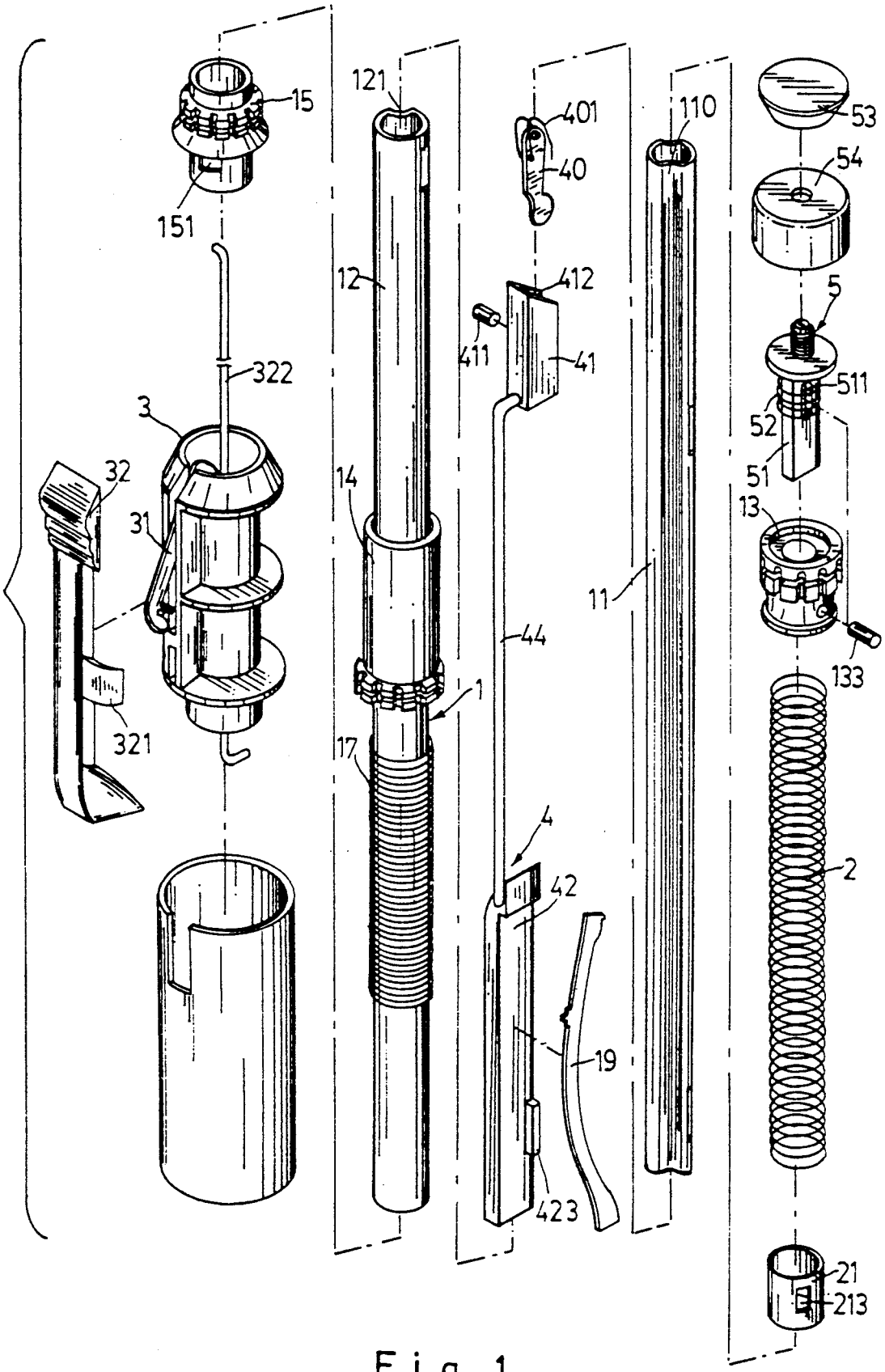
FIG. 1 is an exploded view of a sliding key controlled, folding collapsible frame assembly for an automatic folding umbrella according to the preferred embodiment of the present invention.
Figure 2:
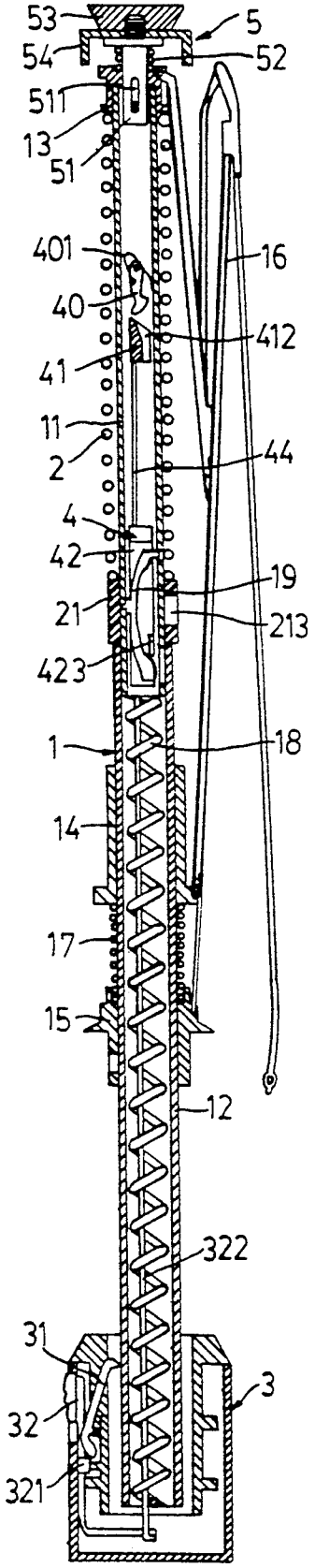
FIG. 2 is a longitudinal sectional assembly view of the folding collapsible frame assembly of FIG. 1 shown the rib and stretcher frame assembly collapsed.

Referring to FIGS. 1 and 2, a sliding key controlled, folding collapsible frame assembly for an automatic folding umbrella in accordance with the present invention is generally comprised of a two-section shaft frame assembly 1, a collapse control spring 2, a sliding lock ring 21, a handle 3, a guide control mechanism 4, and a fail safe mechanism 5.

The two-section shaft frame assembly 1 comprises a lower shaft 12, an upper shaft 11 made to slide in the lower shaft 12, a fixed member 13 fastened to the upper shaft 11 at the top, an upper runner 14 and a lower runner 15 made to slide along the lower and upper shafts 12;11, a stretch control spring 17 retained between the upper runner 14 and the lower runner 15, a spring 18 received inside the lower shaft 12 and compressed by the upper shaft 11. The upper shaft 11 comprises a dent 110 on the outside along the length. The lower shaft 12 comprises an inside projection 121 longitudinally extended downwards from the top on the inside and engaged into the dent 110 on the upper shaft 11, therefore the upper shaft 11 is stably guided to slide in the lower shaft 12. A rib and stretcher frame assembly 16 is fastened to the fixed member 13, upper runner 14, and lower runner 15 of the two-section shaft frame assembly 1 to hold a cloth cover (not shown). The lower runner 15 comprises a hook hole 151 releasably hooked by a bottom spring 31 on the handle 3. As the umbrella is collapsed, the stretch control spring 17 is compressed, and the lower runner 15 is retained by the bottom spring 31 of the handle 3, and the spring 18 is also compressed. As the springs 17;18 are released, the umbrella is automatically stretched open. The sliding lock ring 21 is slidably mounted around the runner 14. The collapse control spring 2 is mounted around the upper shaft 11 and retained between the fixed member 13 and the sliding lock ring 21.

The handle 3 is fastened to the lower shaft 12 at the bottom, and comprised of a bottom spring 31 hooked on the hook hole 151 of the lower runner 15, a control button 32 having a push block 321 moved upwards to release the bottom spring 31 from the hook hole 151 of the lower runner 15, and a pull wire 322 connected to the guide control mechanism 4.

Figure 4:
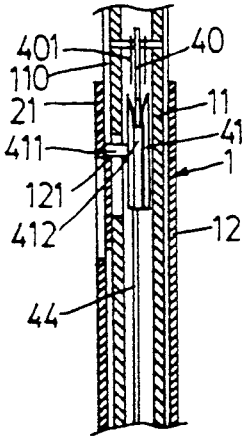
FIG. 4 illustrates the sliding key moved by the inside projection of the lower shaft to move the hook into a hooked position hooking on the lock ring.
Figure 9:
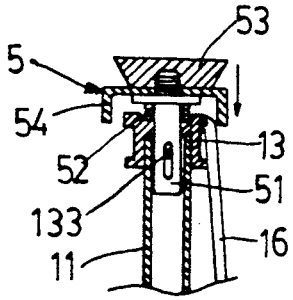
FIG. 9 is a sectional view showing the rib and stretcher frame assembly retained in the collapsed position by the cap of the fail safe mechanism.

The guide control mechanism 4 comprises a hook 40 fixed inside the upper shaft 11 and constantly retained inwards by a spring element 401, a sliding key 41 having a top recess 412 moved to push the hook 40 out of the upper shaft 11 in hooking the lock ring 21 (see FIG. 4) and a guide rod 411 and one side stopped against the inside projection 121 of the lower shaft 12 at the top, and a transmission element 42 having a top end connected to the sliding key 41 by a pull wire 44 and a bottom end connected to the pull wire 322 of the handle 3. The transmission element 42 comprises a projecting block 423 moved to control the position of a top spring 19. The top spring 19 is fastened inside the shaft frame assembly 1 and controlled to stop the upper and lower shafts 11;12 in the extended out position, or to allow the upper shaft 11 to be received inside the lower shaft 12. The fail safe mechanism 5 comprises an actuating element 51 supported on the fixed member 13 by a spring 52 and having an elongated hole 511 vertically slidably fastened inside the fixed member 13 by a pin 133, a cap 54 fastened to the actuating element 51 at the top by a packing nut 53. As the umbrella is collapsed, the rib and stretcher frame assembly 16 is retained in the collapsed position by the cap 54, and prohibited from been opened (see FIG. 9).

Figure 3:
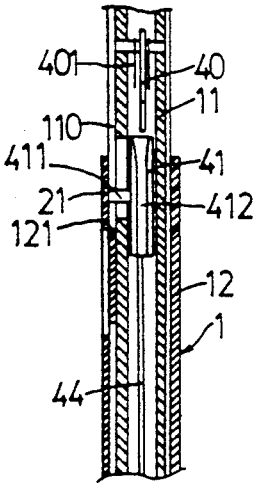
FIG. 3 is a partial sectional view showing the hook and sliding key of the guide control mechanism fastened inside the upper shaft.
Figure 6:
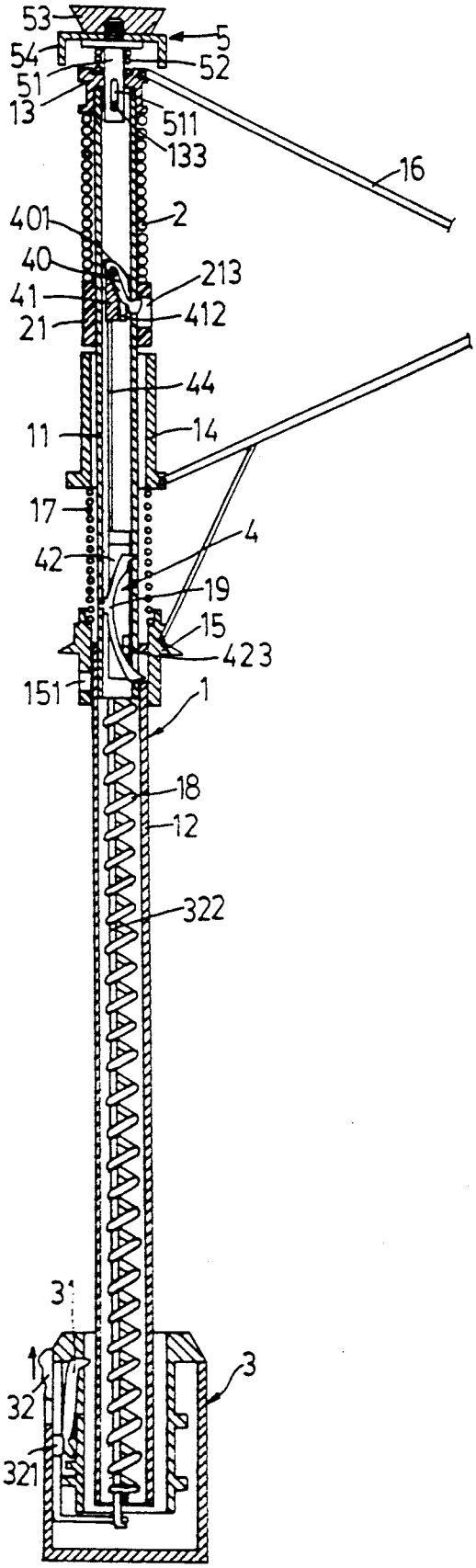
FIG. 6 shows the folding collapsible frame assembly completely stretched out.
Figure 5:
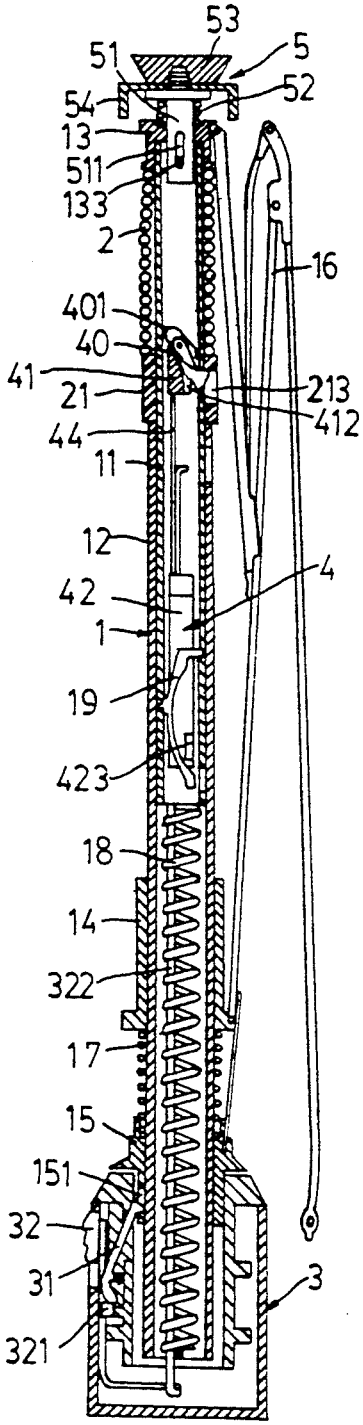
FIG. 5 shows the folding collapsible frame assembly completely collapsed.

As the cloth cover of the umbrella is folded up as shown in FIG. 2, the stretch control spring 17 is compressed by the upper and lower runners 14;15. The folding collapsible frame assembly can be conveniently collapsed by pressing the packing nut 53 of the fail safe mechanism 5 against the ground or an object, causing the upper shaft 11 to slide into the lower shaft 12. At the same time, the collapse control spring 2 is compressed against the lock ring 21. As the upper shaft 11 is completely received in the lower shaft 12, the bottom spring 31 hooks into the lock hole 151 on the lower runner 15 to hold the folding collapsible frame assembly in the collapsed position. As the upper shaft 11 slides into the lower shaft 12, the inside projection 121 of the lower shaft 12 pushed the guide rod 411 upwards, causing the hook 40 to hook in the hook role 213 on the lock ring 21 (see FIGS. 3 and 4). Opening the umbrella is quite simple. Pushing the control button 32 upwards causes the push block 321 to move the bottom spring 31 out of the lock hole 151 on the lower runner 15, and therefore the stretch control spring 17 is released to push the upper and lower runners 14;15 apart. As the upper and lower runners 14;15 are moved apart, the upper shaft 11 is extended out of the lower shaft 12. As the upper and lower shafts 11;12 are extended out, the pull wire 322 is stretched tight, and the collapse control spring 2 is compressed (see FIG. 6). If the control button 32 is pushed downwards to pull the pull wire 322, the transmission element 42 is driven to pull the sliding key 41 downwards, causing the hook 40 to be moved back inside the upper shaft 11 by the spring element 401, and therefore the lock ring 21 is released from the hook 40. As the lock ring 21 is released from the hook 40, the collapse control spring 2 immediately pushes the upper runner 14 downwards to collapse the rib and stretcher frame assembly 16. As the same time, the projecting block 423 is moved downwards to press the top spring 19, causing the top spring 19 to release from the upper shaft 11 for allowing the upper shaft 11 to be moved into the lower shaft 12 (see FIG. 2).

Figure 8:
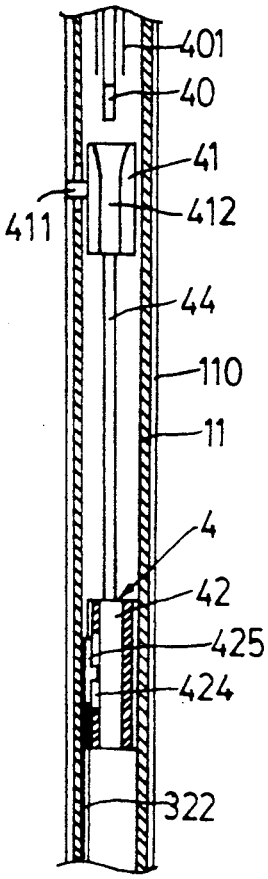
FIG. 8 is a sectional view showing the alternate form of the guide control mechanism fastened inside the upper shaft.
Figure 7:
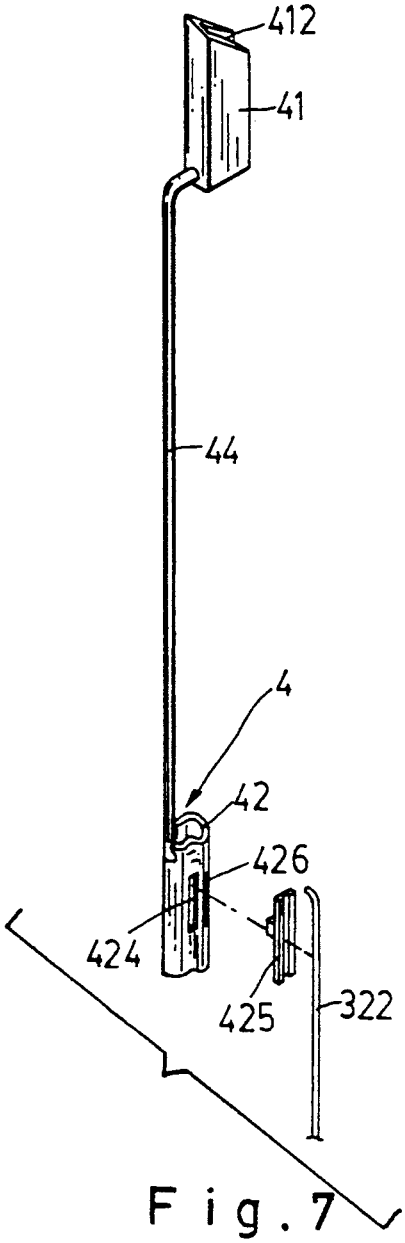
FIG. 7 is a perspective view of the alternative form of the guide control mechanism.

Referring to FIGS. 7 and 8, therein illustrated is an alternate form of the present invention. In this alternate form, the transmission element 42 of the guide control mechanism 4 is made in a tubular configuration having a first elongated hole 424, in which a slide 425 which is coupled to the handle 3 slides, and a second elongated hole 426 moved to release the top spring 19 from the upper shaft 11.

What is claimed is:

1. A folding collapsible frame assembly for an automatic folding umbrella of the type comprising a two-section shaft frame assembly, said two-section shaft frame assembly comprising a lower shaft, an upper shaft made to slide in said lower shaft, a fixed member fastened to said upper shaft at the top, and upper runner and a lower runner made to slide along said lower and upper shafts, a stretch control spring retained between said upper runner and said lower runner, an inside spring received inside said lower shaft and stopped against said upper shaft, and a top spring fastened inside said top shaft at the bottom and releasably engaged into a hole on said lower shaft to stop said upper shaft out of said lower shaft; and a handle fastened to said lower shaft at the bottom, said handle comprising a bottom spring releasably hooked in said lower runner, a control button having a push block moved to release said bottom spring from said lower runner; the improvement comprising:

an inside projection made on said lower shaft at the top and moved to slide along a longitudinal dent on said upper shaft;

a lock ring made to slide on said upper and lower shafts and stopped above said upper runner, said lock ring having a hook hole on the periphery;

a guide control mechanism fastened inside said upper shaft, said guide control mechanism comprising a hook fixed inside said upper shaft and constantly retained inwards by a spring element, a sliding key having a top recess moved to push the hook thereof out of a hole on said upper shaft in hooking the hook hole on said lock ring, a guide rod at one side stopped against said inside projection of said lower shaft at the top, a transmission device having one end connected to said sliding key by a pull wire and an opposite end connected to said control button of said handle by a pull wire, and a top spring fastened inside said top shaft and projected out of a hole on said top shaft to stop said lower shaft above said lower shaft, said transmission element comprises projecting block moved to release said top spring from said lower shaft for permitting said top shaft to be moved inside said lower shaft;

a fail safe mechanism disposed above said fixed member, said fail safe mechanism comprising an actuating element supported on said fixed member by a spring and having an elongated hole vertically slidably fastened inside said fixed member by a pin, a cap fastened to said actuating element at the top by a packing nut;

whereby compressing said upper shaft against said lower shaft caused said collapse control spring to be compressed by said lock ring against said fixed member, and simultaneously causes the hook of said guide control mechanism to be moved upwards by said inside projection of said lower shaft via said sliding key into a hooked position hooking into the hook hole on said lock ring in holding the umbrella in the collapsed position; pushing said control button upwards causes said bottom spring to release said lower runner for allowing the umbrella to be opened; pushing said control button downwards to pull the linked pull wire caused the hook of said guide control mechanism to be released from said locking ring for permitting said collapse control spring to push said upper runner downwards and simultaneously to collapse the umbrella.

2. The folding collapsible frame assembly of claim 1 wherein said transmission comprises a short tube having an elongated hole vertically disposed on the periphery, and a slide element made to slip in the elongated hole of said short tube and connected to said control button of said handle.

* * * * *

UNITED STATES PATENT AND TRADEMARK OFFICE

CERTIFICATE OF CORRECTION

PATENT NO. : 5,309,932

DATED : May 10, 1994

INVENTOR(S) : CHOU et al.

It is certified that error appears in the above-identified patent and that said Letters Patent is hereby corrected as shown below:

Column 2, line 32, after 'the' insert --upper and lower shafts 11; 12 and stopped above the upper--.

Signed and Sealed this

Twenty-eight Day of February, 1995

*Attest:*

Bruce Lehman

BRUCE LEHMAN

*Attesting Officer*

*Commissioner of Patents and Trademarks*